US009236182B2

(12) United States Patent
Sim et al.

(10) Patent No.: US 9,236,182 B2
(45) Date of Patent: Jan. 12, 2016

(54) COMMON MODE FILTER

(71) Applicant: Samsung Electro-Mechanics Co., Ltd., Suwon (KR)

(72) Inventors: Won-Chul Sim, Suwon (KR); Seung-Wook Park, Suwon (KR); Doo-Sung Jung, Suwon (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/267,506

(22) Filed: May 1, 2014

(65) Prior Publication Data

US 2015/0130581 A1 May 14, 2015

(30) Foreign Application Priority Data

Nov. 13, 2013 (KR) ..... 10-2013-0137831

(51) Int. Cl.

| | |
|---|---|
| ***H01F 5/00*** | (2006.01) |
| ***H01F 27/34*** | (2006.01) |
| ***H01F 27/33*** | (2006.01) |
| ***H01F 38/00*** | (2006.01) |

(52) U.S. Cl.

CPC ..... *H01F 27/345* (2013.01); *H01F 5/00* (2013.01); *H01F 27/33* (2013.01); *H01F 38/00* (2013.01)

(58) Field of Classification Search

CPC ..... H01F 5/00; H01F 27/00–27/30
USPC ..... 336/65, 83, 200, 232
See application file for complete search history.

(56) References Cited

U.S. PATENT DOCUMENTS

| | | | | |
|---|---|---|---|---|
| 2004/0061587 | A1* | 4/2004 | Hong et al. | 336/200 |
| 2013/0141206 | A1* | 6/2013 | Lee et al. | 336/200 |
| 2014/0167902 | A1* | 6/2014 | Yoon et al. | 336/207 |

FOREIGN PATENT DOCUMENTS

JP 201014164 A * 6/2010

* cited by examiner

*Primary Examiner* — Tuyen Nguyen
(74) *Attorney, Agent, or Firm* — McDermott Will & Emery LLP

(57) ABSTRACT

A common mode filter is disclosed. The common mode filter provided by the present invention includes: a magnetic substrate; a coil layer formed on the magnetic substrate and including a coil pattern; an external electrode formed on the coil layer so as to be electrically connected with the coil pattern; a ground electrode formed on the coil layer and configured to discharge static electricity brought in to the external electrode; a post formed on each of the external electrode and the ground electrode; and an electrostatic discharge member formed between the external electrode and the ground electrode so as to cover a side surface of the post and configured to discharge static electricity brought in to the external electrode to the ground electrode.

20 Claims, 4 Drawing Sheets

Size of Turn-On Voltage according to Electrostatic Discharge Member

COMMON MODE FILTER

CROSS-REFERENCE TO RELATED APPLICATIONS

This application claims the benefit of Korean Patent Application No. 10-2013-0137831, filed with the Korean Intellectual Property Office on Nov. 13, 2013, the disclosure of which is incorporated herein by reference in its entirety.

BACKGROUND

1. Technical Field

The present invention relates to a common mode filter.

2. Background Art

High-speed digital interfaces, such as USB, require a part that addresses noise. One of such parts that removes common mode noise selectively is a common mode filter.

Common mode noise can occur when impedance fails to be parallel in the wiring system. The common mode noise can occur more often for higher frequency. Since the common mode noise can be also transferred to, for example, the surface of the earth and bounced back with a big loop, the common mode noise causes various kinds of noise troubles in far-away electronic devices.

The common mode filter can allow a differential mode signal to bypass while selectively removing the common mode noise. In the common mode filter, magnetic flux is canceled out by the differential mode signal, causing no inductance to occur and allowing the differential mode signal to bypass. On the other hand, magnetic flux is augmented by the common mode noise, increasing the inductance and allowing the noise to be removed.

The related art of the present invention is disclosed in Korea Patent Publication No. 2011-0129844 (COMMON MODE NOISE FILTER; laid open on Dec. 6, 2011).

SUMMARY

The present invention provides a common monde filter that includes a post having a side surface thereof covered by an electrostatic discharge member.

An aspect of the present invention provides a common mode filter, which includes: a magnetic substrate; a coil layer formed on the magnetic substrate and including a coil pattern; an external electrode formed on the coil layer so as to be electrically connected with the coil pattern; a ground electrode formed on the coil layer and configured to discharge static electricity brought in to the external electrode; a post formed on each of the external electrode and the ground electrode; and an electrostatic discharge member formed between the external electrode and the ground electrode so as to cover a side surface of the post and configured to discharge static electricity brought in to the external electrode to the ground electrode.

The post can be made of a conductive material.

A distance between the post and another post can be greater than a distance between the external electrode and the ground electrode.

The electrostatic discharge member can cover upper surfaces of the external electrode and the ground electrode.

An upper surface of the electrostatic discharge member can be bulged outwardly.

An upper surface of the electrostatic discharge member can have an inwardly concave shape.

A ratio of a distance between the external electrode and the ground electrode to a maximum thickness of the electrostatic discharge member can be smaller than or equal to 1.5.

The common mode filter can further include a magnetic layer interposed between the coil layer and the external electrode.

The common mode filter can further include a protective layer formed on the electrostatic discharge member.

The protective layer can be formed between the post and another post.

The electrostatic discharge member can include resin having metal particle contained therein.

DETAILED DESCRIPTION

Figure 1:
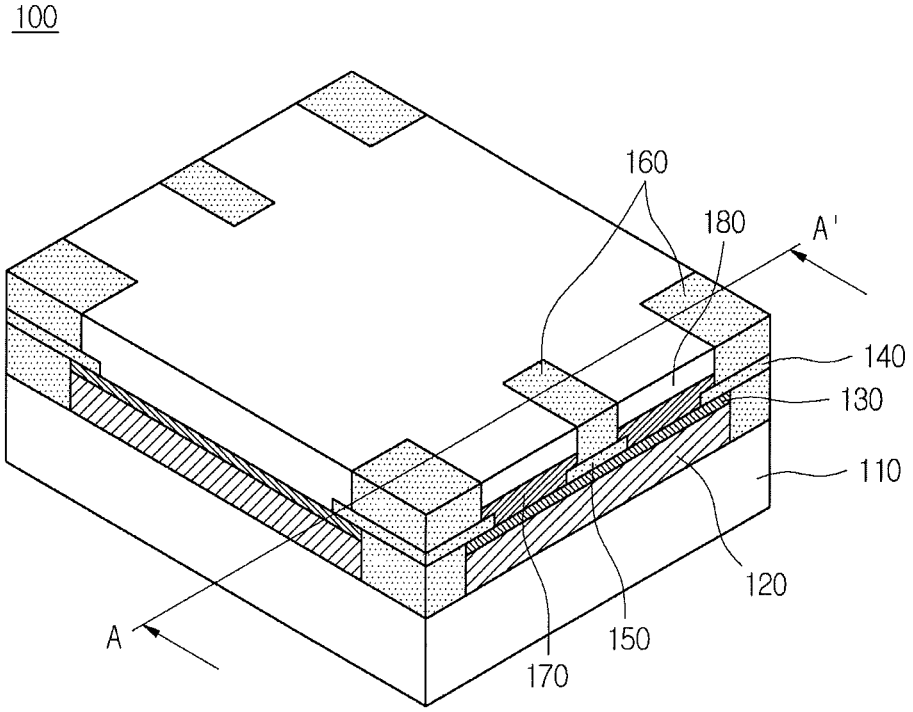
FIG. 1 show a common mode filter in accordance with an embodiment of the present invention.

Hereinafter, a certain embodiment of a common mode filter and a manufacturing method thereof in accordance with the present invention will be described in detail with reference to the accompanying drawings. In describing the present invention with reference to the accompanying drawings, any identical or corresponding elements will be assigned with same reference numerals, and no redundant description thereof will be provided.

Terms such as "first" and "second" can be used in merely distinguishing one element from other identical or corresponding elements, but the above elements shall not be restricted to the above terms.

When one element is described to be "coupled" to another element, it does not refer to a physical, direct contact between these elements only, but it shall also include the possibility of yet another element being interposed between these elements and each of these elements being in contact with said yet another element.

Figure 2:
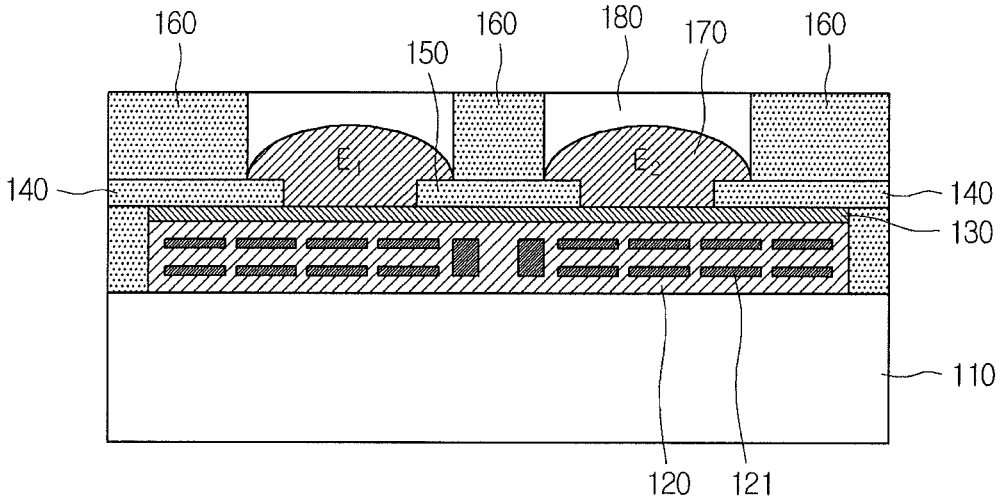
FIG. 2 is a cross-sectional view showing the common mode filter in accordance with an embodiment of the present invention.
Figure 3:
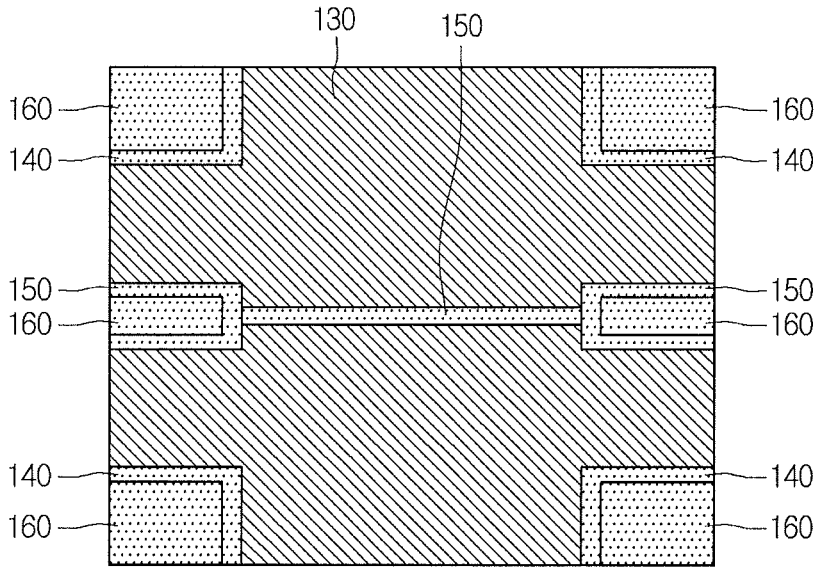
FIG. 3 shows a post of the common mode filter in accordance with an embodiment of the present invention.
Figure 4:
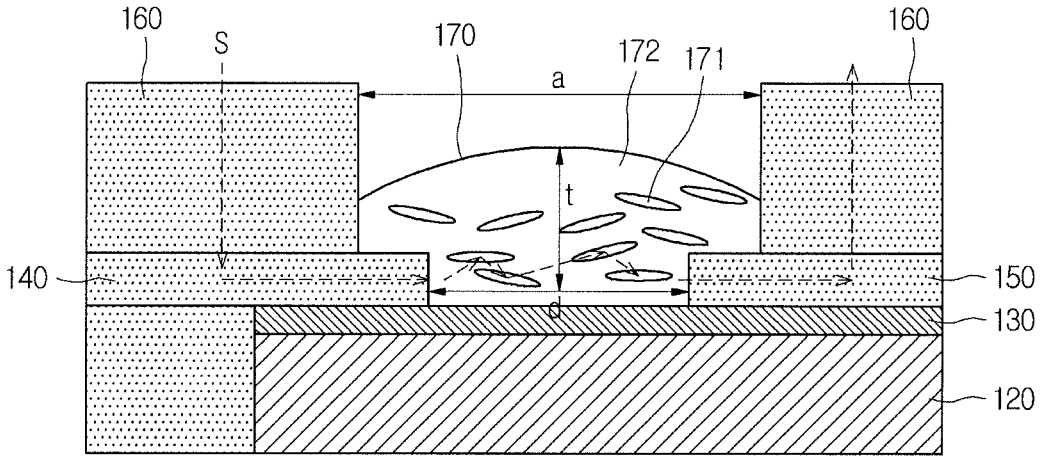
FIG. 4 shows an electrostatic discharge member of the common mode filter in accordance with an embodiment of the present invention.

FIG. 1 show a common mode filter in accordance with an embodiment of the present invention, and FIG. 2 is a cross-sectional view showing the common mode filter in accordance with an embodiment of the present invention. FIG. 3 shows a post of the common mode filter in accordance with an embodiment of the present invention, and FIG. 4 shows an electrostatic discharge member of the common mode filter in accordance with an embodiment of the present invention.

Referring to FIG. 1 and FIG. 2, a common mode filter 100 in accordance with an embodiment of the present invention can include magnetic substrate 110, coil layer 120, magnetic layer 130, external electrode 140, ground electrode 150, post 160 and electrostatic discharge member 170.

The magnetic substrate 110 is a board that is magnetic and is placed at a lowermost location of the common mode filter.

The magnetic substrate 110 can include at least one of metal, polymer and ceramic, which are magnetic materials.

The coil layer 120 can be formed on the magnetic substrate 110 and can include a coil pattern 121, which includes coils and functions as an inductor. Each coil in the coil pattern 121 can be formed in a helical shape and can be formed to be adjacent to but not to overlap with another coil. As the helical shape of coil in the coil pattern 121 can make the length of the coil elongated, inductance can be increased.

The coil pattern 121 can include dual layers of coils. Each coil in the first layer is in the shape of winding in from an outside to an inside while each coil in the second layer is in the shape of winding out from an inside to an outside.

The coils in the coil pattern 121 can be formed in pairs. Magnetic coherence occurs in between the pair of coils of the coil pattern 121. In the case of common mode noise, the inductance becomes augmented as the magnetic flux occurred by the common mode noise is combined.

The coil pattern 121 can be made of copper (Cu) or aluminum (Al), which is highly conductive and workable. Moreover, the coil pattern 121 can be formed through photolithography and plating.

The coil layer 121 can include a dielectric layer. More specifically, the coil layer 120 can include a dielectric layer that encompasses the coil pattern 121. In such a case, the coil pattern 121 can be formed to be surrounded by the dielectric layer. The dielectric layer can insulate the coil pattern 121 from the magnetic substrate 110. The dielectric layer can be formed on the magnetic substrate 110. Preferably used as a material for the dielectric layer can be polymer resin, for example, epoxy resin or polyimide resin, which has a good electrical insulation property and is highly workable.

The dielectric layer can be partially formed before the coil pattern 121 is formed, and then another portion of the dielectric layer can be successively formed after the coil pattern 121 is formed so as to cover the coil pattern 121. Accordingly, the dielectric layer can cover all of an upper part, a lower part and side surfaces of the coil pattern 121.

The magnetic layer 130 is a layer that is formed on the coil layer 120 and is magnetic. The magnetic layer 130 forms a closed-magnetic circuit together with the magnetic substrate 110. Magnetic coupling of the coil pattern 121 can be enhanced by the strong magnetic flux formed by the magnetic layer 130 and the magnetic substrate 110.

The magnetic layer 130 can include magnetic powder and resin material. The magnetic powder allows the magnetic layer to be magnetic, and the resin material allows the magnetic layer 130 to have fluidity. In such a case, the magnetic powder can include ferrite.

The external electrode 140 can be formed on the coil layer 120 so as to be electrically connected with the coil pattern 121. The external electrode 140 is configured for inputting a signal to the coil pattern 121 and outputting a signal from the coil pattern 121. In the case where the magnetic layer 130 is formed on the coil layer 120, the external electrode 140 can be formed on the magnetic layer 130.

In the case where the coil pattern 121 is formed in pair, the external electrode 140 can be formed in the quantity of four, as shown in FIG. 3. Two of the four external electrodes 140 can be input electrodes, and the other two of the four external electrodes 140 can be output electrodes.

The ground electrode 150 is configured for discharging static electricity brought in to the external electrode 140. Like the external electrode 140, the ground electrode 150 can be formed on the coil layer 120. In the case where the magnetic layer 130 is formed on the coil layer 120, the ground electrode 150 can be formed on the magnetic layer 130. The ground electrode 150 is not electrically connected with the coil pattern 121 and, as illustrated in FIG. 3, can be formed in between an external electrodes 140 and another external electrode 140.

Referring to FIG. 3, the post 160 can be formed on each of the external electrode 140 and the ground electrode 150. The post 160 can be made of a conductive material. By forming the post 160 with a conductive material, the post 160 can play the same role as the external electrode 140 and the ground electrode 150. In such a case, the post 160 can be made of a same kind of metal as the external electrode 140 and the ground electrode 150. For example, the external electrode 140, the ground electrode 150 and post 160 can be made of copper. The post 160 can be formed by plating.

As illustrated in FIG. 4, a distance (a) between a post 160 and another post 160 can be greater than a distance (d) between the external electrode 140 and the ground electrode 150. As such, when the distance between the posts 160 is greater than the distance between the external electrode 140 and the ground electrode 150, it becomes possible to prevent pores from forming inside the electrostatic discharge member 170.

The electrostatic discharge member 170 is a material that basically has a high resistance but quickly drops the resistance in case a high voltage of surge S is brought in. The electrostatic discharge member 170 can be placed between the external electrode 140 and the ground electrode 150.

The electrostatic discharge member 170 can be formed to cover a side surface of the post 160. The electrostatic discharge member 170 can cover the side surface of the post 160 by being formed to be thicker than the external electrode 140 and the ground electrode 150.

Referring to FIG. 4, the electrostatic discharge member 170 can be formed in such a way that an upper surface thereof bulges out. Moreover, the electrostatic discharge member 170 can be formed so as to cover upper surfaces of the external electrode 140 and the ground electrode 150. Accordingly, the electrostatic discharge member 170 can have the shape of a mushroom, of which a lower-most surface has the narrowest width.

As illustrated in FIG. 4, the electrostatic discharge member 170 can be resin 172 having metal particles 171 included therein. The metal particles 171 can be in the shape of being extended in one direction. With this kind of electrostatic discharge member 170, the metal particles 171 are arranged in no particular direction when the voltage is smaller than a specific value, but the metal particles 171 are arranged in a particular direction when the voltage is greater than or equal to the specific value, allowing the electric current to flow along the metal particles 171. This specific value can be referred to as turn-on voltage.

The electrostatic discharge member 170 can be printed by a screen printing method. In such a case, a mask having an opening formed therein in correspondence with a position where the electrostatic discharge member 170 is to be formed can be placed on the external electrode 140 and the ground electrode 150, and then the electrostatic discharge member 170 can be coated in the opening. The electrostatic discharge member 170 can be in a liquid state and thus can have fluidity. The electrostatic discharge member 170 can be cured at a high temperature after having been printed.

The post 160 can prevent the electrostatic discharge member 170 that is being printed from escaping between the external electrode 140 and the ground electrode 150. If the electrostatic discharge member 170 deviated vastly, an electrostatic discharge member E1 and another electrostatic discharge member E2 could overlap with each other, and the electrostatic discharging function could be weakened. The post 160 can maximize the electrostatic discharging function by guiding the position where the electrostatic discharge member 170 is to be formed.

A protective layer 180 can be formed on the electrostatic discharge member 170 and protect the electrostatic discharge member 170. In such a case, the protective layer 180 can be formed in between the posts 160. The protective layer 180 can include magnetic powder, for example, ferrite.

Figure 5:
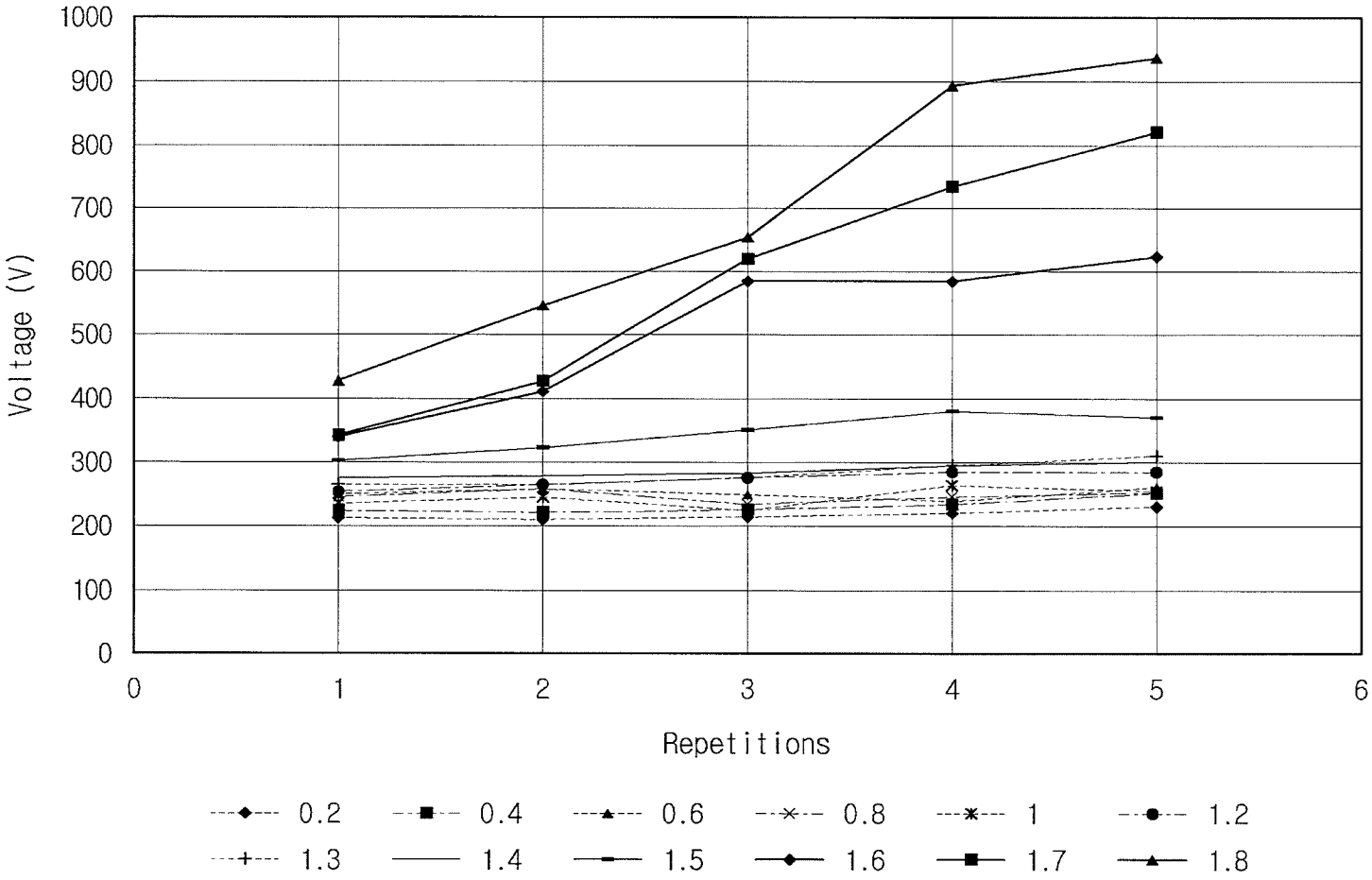
FIG. 5 is a graph showing the size of turn-on voltage according to the electrostatic charge member of the common mode filter in accordance with an embodiment of the present invention.

Referring to FIG. 5, a ratio of the distance between the external electrode 140 and the ground electrode 150 to a maximum thickness of the electrostatic discharge member 170 can satisfy to be 1.5 or less. In the graph shown in FIG. 5, the turn-on voltage is measured while the ratio (d/t) of the distance between the external electrode 140 and the ground electrode 150 to the maximum thickness of the electrostatic discharge member 170 is changed from 0.2 to 1.8.

In the graph, when the ratio (d/t) of the distance between the external electrode 140 and the ground electrode 150 to the maximum thickness of the electrostatic discharge member 170 is over 1.5, the turn-on voltage becomes sharply higher as voltage is repeatedly supplied. In the meantime, when the ratio (d/t) of the distance between the external electrode 140 and the ground electrode 150 to the maximum thickness of the electrostatic discharge member 170 is 1.5 or less, the turn-on voltage is relatively constant even though voltage is repeatedly supplied.

In other words, the reliability of the electrostatic discharging function of the common mode filter 100 can be maximized when the ratio (d/t) of the distance between the external electrode 140 and the ground electrode 150 to the maximum thickness of the electrostatic discharge member 170 is 1.5 or less.

As described above, with the common mode filter 100 in accordance with an embodiment of the present invention, it becomes possible to prevent the electrostatic discharge member 170 from spreading because the position where the electrostatic discharge member 170 is to be formed can be guided by the post 160. Accordingly, the electrostatic discharging function can be improved.

Figure 6:
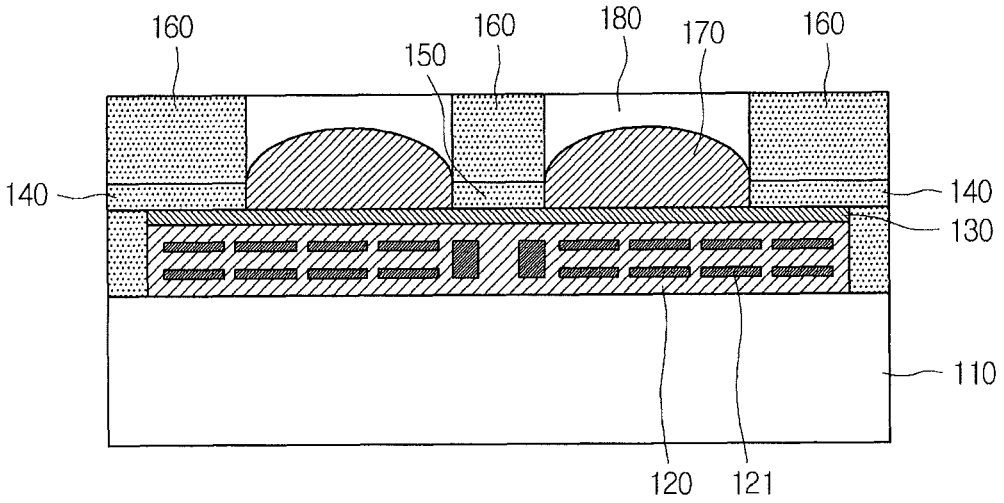
FIGS. 6 and 7 each show a common mode filter in accordance with various embodiments of the present invention.
Figure 7:
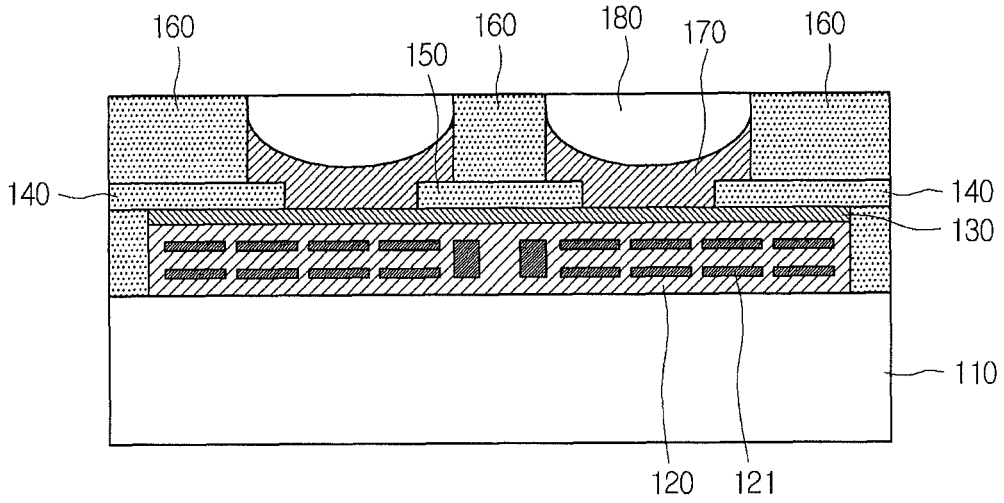

FIG. 6 and FIG. 7 show common mode filters in accordance with various embodiments of the present invention. The common mode filters 100 illustrated in FIGS. 6 and 7 are different in their shapes of the post 160 and the electrostatic discharge member 170 from those of the earlier-described common mode filter 100.

Referring to FIG. 6, the post 160 can be formed to have a same width as those of the external electrode 140 and the ground electrode 150. Accordingly, the electrostatic discharge member 170 can have a dome shape.

Referring to FIG. 7, the post 160 can be formed to have a narrower width than those of the external electrode 140 and the ground electrode 150, and an upper surface of the electrostatic discharge member 170 can have an inwardly concave shape.

According to the various embodiments of the present invention, it is possible to manufacture various forms of common mode filter.

Although certain embodiments of the present invention have been described, it shall be appreciated that there can be a very large number of permutations and modification of the present invention by those who are ordinarily skilled in the art to which the present invention pertains without departing from the technical ideas and boundaries of the present invention, which shall be defined by the claims appended below.

It shall be also appreciated that many other embodiments than the embodiments described above are included in the claims of the present invention.

What is claimed is:

1. A common mode filter, comprising:

a magnetic substrate;

a coil layer formed on the magnetic substrate and including a coil pattern;

an external electrode formed on the coil layer so as to be electrically connected with the coil pattern;

a ground electrode formed on the coil layer and configured to discharge static electricity brought into the external electrode;

a post formed on each of the external electrode and the ground electrode; and an electrostatic discharge member formed between the external electrode and the ground electrode so as to cover a side surface of the post and configured to discharge static electricity brought into the external electrode to the ground electrode, wherein the electrostatic discharge member is printed between the external electrode and the ground electrode, and wherein the post prevents the electrostatic discharge member from escaping between the external electrode and the ground electrode.

2. The common mode filter of claim 1, wherein the post is made of a conductive material.

3. The common mode filter of claim 1, wherein a distance between the post and another post is greater than a distance between the external electrode and the ground electrode.

4. The common mode filter of claim 1, wherein the electrostatic discharge member covers upper surfaces of the external electrode and the ground electrode.

5. The common mode filter of claim 1, wherein an upper surface of the electrostatic discharge member is bulged outwardly.

6. The common mode filter of claim 1, wherein an upper surface of the electrostatic discharge member has an inwardly concave shape.

7. The common mode filter of claim 1, wherein a ratio of a distance between the external electrode and the ground electrode to a maximum thickness of the electrostatic discharge member is smaller than or equal to 1.5.

8. The common mode filter of claim 1, further comprising a magnetic layer interposed between the coil layer and the external electrode.

9. The common mode filter of claim 1, further comprising a protective layer formed on the electrostatic discharge member.

10. The common mode filter of claim 9, wherein the protective layer is formed between the post and another post.

11. The common mode filter of claim 1, wherein the electrostatic discharge member comprises resin having metal particles contained therein.

12. A common mode filter, comprising:

a magnetic substrate;

a coil layer formed on the magnetic substrate and including a coil pattern;

external electrodes and a ground electrode formed on the coil layer, the external electrodes electrically connected to the coil pattern;

a plurality of posts protruding from the external electrodes and the ground electrode in a direction away from the magnetic substrate; and an electrostatic discharge member extending between adjacent posts.

13. The common mode filter of claim 12, wherein the plurality of posts are made of a conductive material.

14. The common mode filter of claim 12, wherein a distance between adjacent posts is greater than a distance between one of the external electrodes and the ground electrode from which the adjacent posts protrude from.

15. The common mode filter of claim 12, wherein the electrostatic discharge member overlaps with any one of the ground electrode and the external electrodes.

16. The common mode filter of claim 12, wherein an upper surface of the electrostatic discharge member is bulged outwardly or has an inwardly concave shape.

17. The common mode filter of claim 12, wherein a ratio of a distance between one of the external electrodes and the ground electrode to a maximum thickness of the electrostatic discharge member is less than or equal to 1.5.

18. The common mode filter of claim 12, further comprising a magnetic layer interposed between the coil layer and the external electrode.

19. The common mode filter of claim 12, further comprising a protective layer formed on the electrostatic discharge member and extending between adjacent posts.

20. The common mode filter of claim 12, wherein the electrostatic discharge member comprises resin and metal particles dispersed in the resin.

* * * * *